United States Patent [19]

Grave

[11] Patent Number: 4,696,075

[45] Date of Patent: Sep. 29, 1987

[54] FILTER STRUCTURE

[76] Inventor: Dale L. Grave, 125 Queensland Lane North, Plymouth, Minn. 55447

[21] Appl. No.: 820,168

[22] Filed: Jan. 21, 1986

[51] Int. Cl.[4] ..... A47L 11/30

[52] U.S. Cl. ..... 15/321; 15/353; 210/411

[58] Field of Search ..... 15/320, 321, 353; 210/409, 411

[56] References Cited

U.S. PATENT DOCUMENTS 3,339,347 9/1967 Otto ..... 210/411 X 4,586,208 5/1986 Trevarthen ..... 15/321 X

*Primary Examiner*—Chris K. Moore

*Attorney, Agent, or Firm*—Leo Gregory

[57] ABSTRACT

In connection with a surface material cleaning apparatus, a tank of cleaning fluid, an outlet line from the tank to a cleaning head, a suction pump carried by the tank recovering cleaning fluid from the cleaning head, a pump feeding the outlet line from the tank, a bleed line from the pump passing liquid into and through the filter under a relatively high pressure creating a motion of liquid through and about the wall of the filter maintaining the filter wall in a relatively unclogged condition, the cleaning fluid in the tank being recycled for cleaning purposes through the filter at a relatively low pressure.

6 Claims, 3 Drawing Figures

FILTER STRUCTURE

BACKGROUND OF THE INVENTION

1. Field of the Invention

This invention relates to a filter structure in connection with a surface cleaning apparatus.

2. Description of the Prior Art

There are known to be in the prior art cleaning machines which recycle the cleaning fluid used, the machines having filters embodied therein for the recovery of cleaning fluid and its continued use.

An example of the prior art in U.S. Pat. No. 2,223,963 to Nadig in which a rotary head distributes cleaning fluid and a suction line is provided to recover the cleaning fluid to recycle the same for further use but there in no provision for the removal of contaminants from the fluid.

In. U.S. Pat. No. 1,670,934 to Keefer, there is disclosed a scrubbing machine in which a brush is mounted upon a horizontal axis and a fan is used to create suction in the scrubbing chamber. Resulting from the cleaning effort, a mixture of air, dirt, and cleaning fluid is removed by suction into a chamber wherein the dirt settles and a pump attempts to recover the fluid for re-use.

In U.S. Pat. No. 4,466,155 to the applicant there is disclosed a tank which received cleaning fluid recovered from a cleaning application and embodied within the tank is a filter in connection with the outlet line for the re-use of the cleaning fluid, the filter having the tendency to having its outer surface become clogged with the contaminants removed from the recycled cleaning fluid.

SUMMARY OF THE INVENTION

The apparatus to be described herein represents a significant improvement over prior art filter structures utilized for recycling cleaning fluid.

It is a principal object of the invention herein to provide a filter structure in connection with the recycling of a cleaning fluid wherein there is provided an effective means in the operation of a surface cleaning apparatus which will maintain the surface of the filter element in a relatively unclogged condition.

It is a further object herein with reference to the prior object to provide means to maintain said filter element in a relatively unclogged condition by constantly flushing the filter element from within maintaining the surface of the filter element in a fairly unclogged condition.

More specifically, it is an object of the invention herein to provide a stream of liquid under a relatively high pressure to enter the filter element and pass through the body of cleaning fluid flowing through the filter element creating a counter flow through said cleaning fluid, the counter flow passing through the wall of the filter element creating a movement or eddy current about the outer surface of the filter element to maintain said outer surface relatively free from a coating of contaminants.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
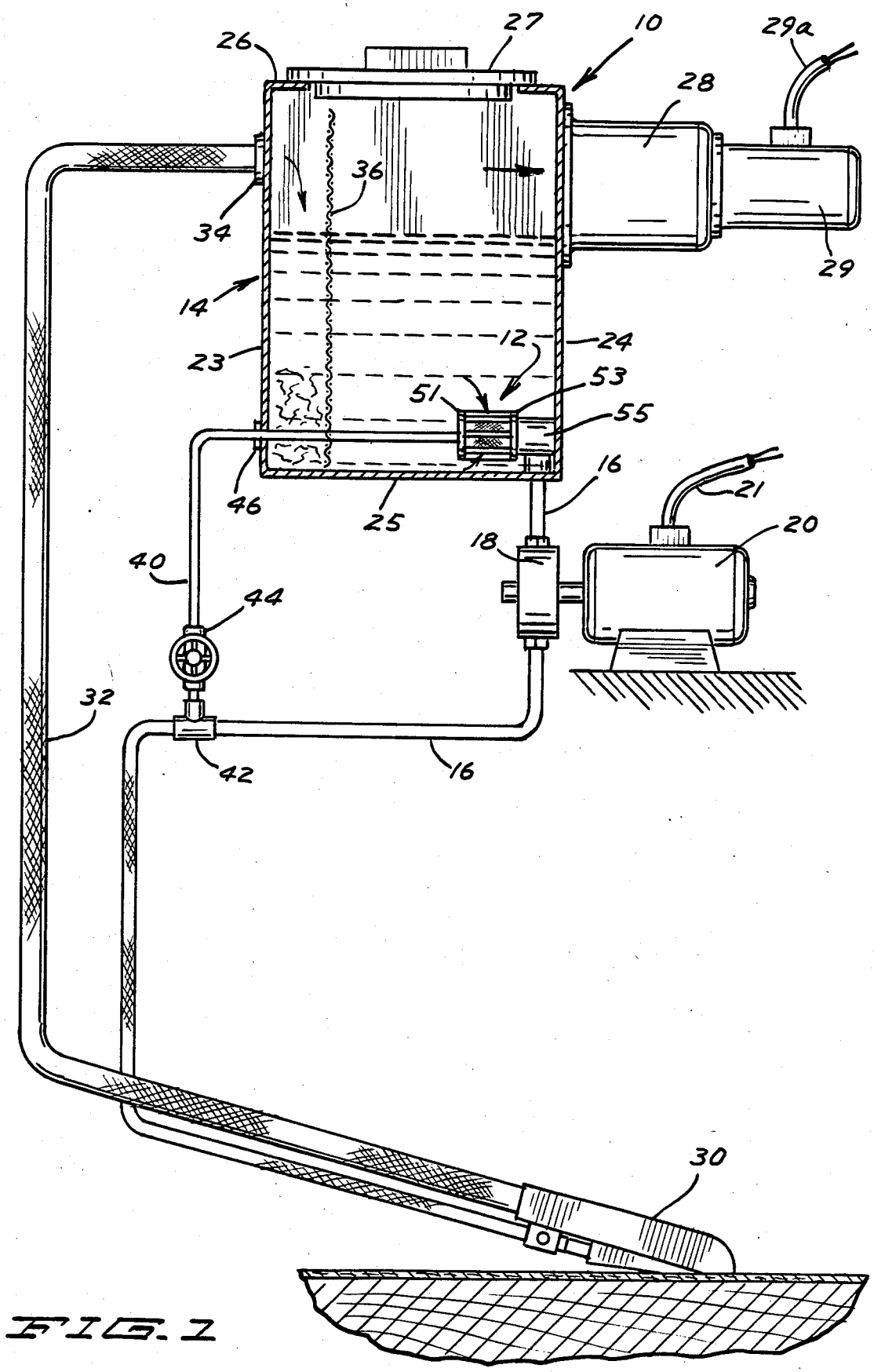
FIG. 1 is a diagrammatic view showing a tank and related portions of a cleaning apparatus with the tank being shown in section and the filter device herein being shown in side elevation in operating position.
Figure 2:
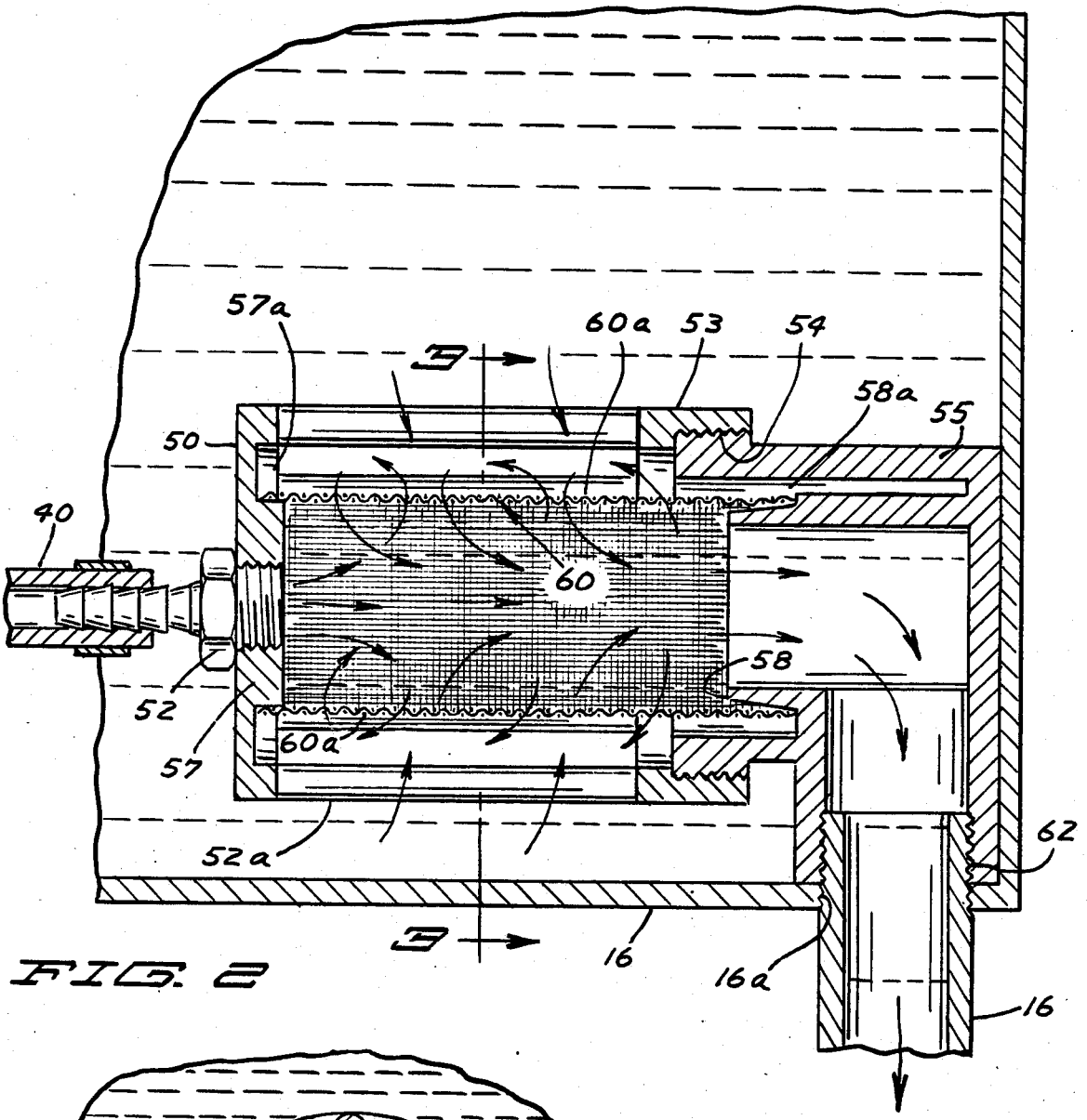
FIG. 2 is a broken view in vertical section on an enlarged scale showing the filter structure herein.
Figure 3:
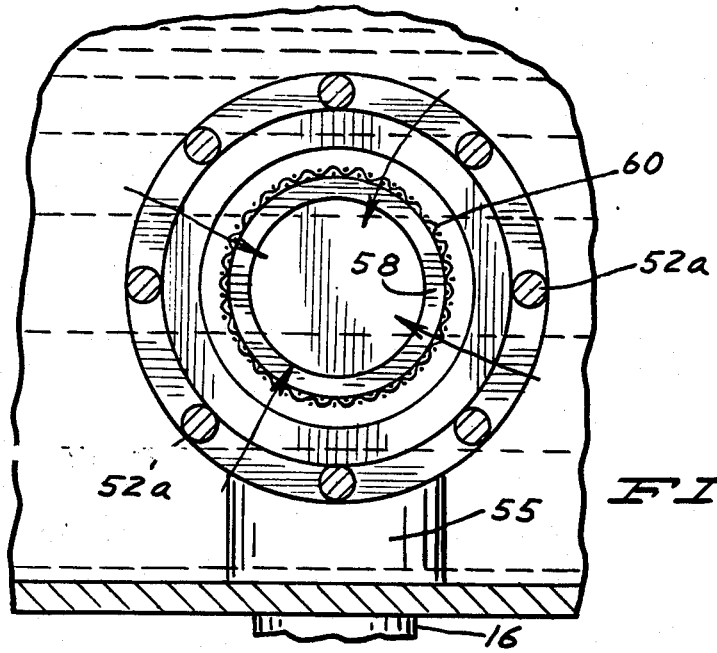
FIG. 3 is a view in vertical section taken on line 3—3 of FIG. 2 as indicated.

Referring to the drawings, a surface material cleaning apparatus is indicated generally by the reference numeral 10 and the filter device or structure disposed therein indicated by the reference numeral 12 represents the subject matter of the invention herein. The terms fluid and liquid are used interchangeably herein.

Said filter device is shown in operating position within the reservoir tank 14 of said cleaning apparatus mounted upon an outlet line 16 which runs to a cleaning head 30, the outlet line being flexible.

Intermediate said line 16 is a pump 18 driven by an electric motor 20 which will be connected by the power line 21 to a suitable power source.

For purposes herein, said tank 14 is shown only in vertical section having side walls 23 and 24, a bottom wall 25 and a top wall 26 having a cover 27 removably disposed therein. The construction of the remainder of the tank is obvious from what is shown.

Mounted upon said wall 24 adjacent the top thereof is a suction pump 28 with an attached motor 29 having an outlet line 29a to be connected to a suitable power source.

A return or suction line 32 runs from the cleaning head 30 to the said tank 14 being attached to the wall 23 by a suitable fitting 34 to discharge into said tank.

A vertical filter member 36 is shown positioned within said tank extending across the interior thereof spaced from said wall 23 to form a trap for larger contaminant items which are picked up by the cleaning head. These contaminants may be removed from the tank from time to time as they collect.

A bleed line 40 is shown taking off from said outlet line 16 by a tee fitting 42 having in connection therewith a suitable adjustable by-pass valve 44. Said bleed line passes through the wall 23 by means of an appropriate fitting 46 and is connected to said filter structure 12 as will be described.

Referring to the particular embodiment of said filter structure 12 here presented for purpose of illustration and not limitation, the same is shown to be substantially cylindrical in form having a cylindrical end wall 50 tapped centrally thereof to have an inlet fitting 52 adapted to have the inlet bleed line 40 secured thereto. Extending from said end wall spaced thereabout are a plurality of rods **52*a* terminating in an annular ring 53 enclosing their free or extended ends. Said annular ring is internally threaded at 54 to receive an elbow fitting 55**.

Said end wall is shown having an internal hub 57 and said elbow fitting has a corresponding facing hub 58, the same respectively having annular spacings **57*a* and 58*a* thereabout. The hub 58 is shown to have a taper for a snug fitting of a cylindrical filter or filter element 60 comprising a mesh or permeable wall disposed and secured between said hubs. Said filter element is wedged securely by the threading of said fitting 55 into said annular ring 53**.

Said filter element 60 is of a suitable mesh to withhold contaminants of any significant size from passing therethrough.

The right angled depending portion 62 of said elbow fitting 55 is internally tapped as is the corresponding opening 16*a* in the bottom wall 16 to receive the corresponding end of the outlet pipe 16.

Said bleed line 40 will be smaller than the outlet pipe 16 and by way of example with the bleed line being on the order of one eighth inch to one quarter inch I.D., the outlet line preferably is on the order of one half inch to one inch I.D.

It will be understood that in lieu of a bleed line from the outlet line 16 supplying a stream of liquid to said filter, that said stream may be supplied from an independent source.

Said pump 18 is adapted to provide a stream of cleaning fluid to the cleaning head 30, such that taking the size of the line 40 as indicated, a fluid pressure is developed on the order of 50 psi or more. The bend in the elbow fitting 55 serves as a baffle to retard the flow of cleaning fluid from the filter into the outgoing line 16.

The purpose of the filter is to provide s substantially cleaned recycling fluid and the purpose of the invention herein is to keep the filter in such a condition that it does not become clogged or ineffective.

The suction pump 28 causes the withdrawal of cleaning fluid from the cleaning head 30, the cleaning fluid being supplied through the line 16, is returned to the tank 14 after a cleaning application by the return line 32.

The bleed line 40 as a take off from said outlet line 16 feeds a stream of the cleaning fluid into said filter element 60 under a pressure substantially greater than the degree of suction under which the cleaning fluid is drawn out of said tank 14 through the filter 12.

As a result, the incoming stream from said line 40 by a counter motion passes through the fluid being drawn through the filter by the pump 18, thus there is here, a swiftly moving stream passing substantially counterwise through a slower moving stream and the swiftly moving incoming stream passes outwardly through the wall 60*a* of the filter element 60 sufficiently to repel the gathering of contaminants upon the outer surface of said filter wall 60*a*. Said stream from said line 40 keeps the fluid about the outer side of said filter wall in sufficient motion to keep said outer side relatively free of an accumulation of contaminants thereupon and thereabout. In practice, it has been experienced that the filter is kept unclogged and the cleaning fluid in the reservoir is drawn freely through the filter by the pump 18. The recycled fluid recovered from the surfaces being worked upon by the cleaning apparatus is sufficiently well filtered as to produce highly acceptable cleaning results.

Keeping the outer surface 60*a* of said filter unclogged permits a uniform stream of cleaning fluid to be delivered through the pump 18 to the cleaning head.

Thus it is seen that I have produced a unique filter arrangement which has been found to be non-clogging and which is believed to represent significant improvement in the art of filtration.

It will of course be understood that various changes may be made in form, details, arrangement and proportions of the product without departing from the scope of applicant's invention which, generally stated, consists in a product capable of carrying out the objects above set forth, such as disclosed and defined in the appended claims.

What is claimed is:

1. A recycling surface cleaning apparatus embodying a nonclogging filter structure, having in combination, a reservoir tank of cleaning fluid of a surface material cleaning apparatus, an outlet line withdrawing said cleaning fluid from said tank and passing the same to a cleaning head, an inlet line from said cleaning head to said tank, means carried by said tank withdrawing cleaning fluid from said cleaning head and drawing the same into said tank through said inlet line, a filter having a wall thereabout within said tank and being connected to said outlet line, means carried by said tank withdrawing cleaning fluid from said cleaning head and drawing the same into said tank through said inlet line, means from said outlet line supplying fluid therefrom into the body of fluid within said filter under a greater pressure than the withdrawal of said cleaning fluid from said tank by said outlet line causing a counterflow motion of fluid within said filter, whereby said counterflow motion causes fluid to pass through portions of the wall of said filter creating adequate motion about said wall to repel interfering contaminants in the cleaning fluid in said tank from collecting upon and clogging said wall of said filter and thus permitting cleaning fluid to be passed through the filter and be withdrawn from said tank.

2. A recycling surface cleaning apparatus embodying a nonclogging filter structure, having in combination a reservoir tank of cleaning fluid of a surface material cleaning apparatus, an outlet line from said tank through a pump to a cleaning head, an inlet line from said cleaning head to said tank, a filter having a wall thereabout within said tank connected to said outlet line, said pump withdrawing said cleaning fluid from said tank through said filter, a line from said outlet line passing fluid therefrom with a greater velocity into said filter than the velocity of the withdrawal of said cleaning fluid through said filter creating a flow within said filter and causing a passage of fluid through said wall of said filter, said fluid creating such motion in the fluid in the tank about said filter in passing through portions of the wall of said filter as to sufficiently prevent the gathering of interfering contaminants from said cleaning fluid about and upon said wall of said filter as to permit said fluid to be withdrawn from said tank through said filter.

3. The structure of claim 2, wherein said outlet line has a relatively large diameter and said inlet line has a relatively small diameter with respect to each other.

4. The structure of claim 2, including a suction pump carried by said tank withdrawing said cleaning fluid from said cleaning head through said inlet line.

5. The structure of claim 2, wherein said outlet line is adapted to retard the flow of fluid to said cleaning head.

6. A nonclogging filter structure in connection with a surface material cleaning apparatus, having in combination a filter structure, a filter element disposed in said filter structure, said element having a wall thereabout and a passage therethrough, said filter structure being disposed into a body of cleaning fluid, means in connection with said filter structure withdrawing said cleaning fluid from said body of fluid through said filter, a line passing a liquid into said filter element under greater pressure than said withdrawal of fluid therefrom, said liquid causing a counterflow with said fluid in said filter and some of said liquid and fluid passing through various portions of said filter element and outward of the wall thereof, and said liquid and fluid passing through the wall of said filter being sufficient to cause such motion of the fluid about said filter as to effectively repel the gathering of interfering contaminants from said cleaning fluid upon said wall of said filter and causing said filter to be nonclogging.

* * * * *